US005582374A

United States Patent [19]

Fung et al.

[11] Patent Number: 5,582,374

[45] Date of Patent: Dec. 10, 1996

[54] HORIZONTAL REST FOR AN IRON

[76] Inventors: Chau C. Fung, No. 35-41, Tai Lin Pai Road, Kwai Chung, N.T., Hong Kong; Duncan C. Fung, P.O. Box 11349, Richmond, Va. 23230

[21] Appl. No.: 440,081

[22] Filed: May 12, 1995

[51] Int. Cl.[6] ..... D06F 79/02

[52] U.S. Cl. ..... 248/117.2

[58] Field of Search ..... 248/117.1, 117.2, 248/117.3, 117.4, 117.5, 117.6, 117.7; 38/142

[56] References Cited

U.S. PATENT DOCUMENTS

| | | | |
|---|---|---|---|
| 2,529,132 | 11/1950 | Burnish, III et al. | 248/117.1 |
| 2,655,333 | 10/1953 | Taylor | 248/117.2 |
| 3,184,194 | 5/1965 | Beck | 248/117.2 |
| 3,477,672 | 11/1969 | Agrusa | 248/117.2 |
| 3,785,599 | 1/1974 | Ramirez | 248/117.2 |

*Primary Examiner*—Ramon O. Ramirez
*Attorney, Agent, or Firm*—Norman B. Rainer

[57] ABSTRACT

A rest upon which a hot iron may be placed without scorching an underlying ironing board is made of a monolithic piece of flexible silicone polymer shaped to have a flat base panel, a perimetric retaining wall upwardly emergent from the upper surface of the base panel, a first series of projections directed upwardly from the upper surface, and a second series of projections downwardly directed from the lower surface of the base panel. The projections are preferably elongated ribs of uniform height in parallel arrays wherein the array of the first series is transverse to the array of the second series.

10 Claims, 2 Drawing Sheets

HORIZONTAL REST FOR AN IRON

BACKGROUND OF THE INVENTION

1. Field of the Invention

This invention relates to the ironing of fabrics upon an ironing board having a cover, and more particularly concerns a rest for horizontally seating a hot iron upon an ironing board without damaging the cover.

2. Description of the Prior Art

Following laundering, many fabric items, such as clothing apparel are generally subjected to an ironing process for the purpose of removing wrinkles. In most households, the ironing is done by the housewife employing an ironing board and an electrically heated ironing device customarily referred to merely as an "iron." The ironing board has an elongated flat surface of relatively narrow width disposed horizontally at waist level.

The surface of the ironing board is generally covered with a cushioning pad of about ⅛" thickness. A fabric cover which imposes little sliding frictional drag upon the iron is tautly emplaced over the cushioning pad.

The iron is generally comprised of a forwardly pointed hull portion elongated upon a vertical plane of symmetry and having a sole plate having a flat lower surface. The hull has a truncated rear heel extremity. A handle is upwardly disposed from the hull portion and centered upon said plane of symmetry. An electrical heating element is disposed within the hull portion. A water reservoir may also be disposed within the hull portion for the purpose of generating steam which can be controllably directed onto the garment or other item undergoing ironing. The lower surface is provided with a low friction coating which eases sliding movement of the iron over the items being ironed.

During the ironing process, it is often necessary that both the operator's hands be employed for manipulating the item being ironed or to remove the item and replace it with another. In such instances, the iron must be left unheld. If the iron is merely allowed to remain with the flat lower surface against the ironing board cover, sufficient heat will accumulate to raise the temperature beneath the iron to a level where the cover will sustain thermal damage such as scorching, burning or ignition. To avoid such damage, the heel portion of most irons is configured in a manner such that the iron can be balanced thereupon in an upright position, thereby removing the lower surface from contact with the ironing board cover. However, in such upright position, the iron is usually unstable with respect to toppling, and can fall off the ironing board. Also, the need to repeatedly manipulate the iron from its horizontal, working disposition to the upright parked or storage disposition can aggravate the already wearisome chore of ironing.

Numerous types of seating plates for irons have been disclosed in the prior art which permit storage of the iron with its lower surface parallel to the ironing board cover. Such plates generally utilize special construction whereby, even though the uppermost portion becomes extremely hot, minimal heat is transferred from the iron to the ironing board cover. Plates of the aforesaid nature generally sit relatively high above the ironing board and are constructed of metal. These factors present a burn hazard to the housewife, particularly because the severity of burns of the skin are dependent upon the temperature and heat transfer characteristics of the hot surface. Also, repeated contact with metal surfaces will wear away the low friction coating on the lower surface of the iron. Further, the iron can easily accidentally slide off a metal surface.

It is accordingly an object of the present invention to provide a rest for receiving an iron upon an ironing board having a cover without damaging the cover.

It is another object of this invention to provide a rest as in the foregoing object which permits the hot lower surface of the iron to be horizontally disposed in parallel relationship to the ironing board.

It is a further object of the present invention to provide a rest of the aforesaid nature which will not scorch the cover of an ironing board when a hot iron is seated upon said rest.

It is a still further object of this invention to provide a rest of the aforesaid nature which minimizes burn risk to the user and provides non-sliding interaction between the ironing board cover and an iron.

It is yet another object of the present invention to provide a rest of the aforesaid nature of simple, durable constriction amenable to low cost manufacture.

These objects and other objects and advantages of the invention will be apparent from the following description.

SUMMARY OF THE INVENTION

The above and other beneficial objects and advantages are accomplished in accordance with the present invention by an iron rest of monolithic molded construction fabricated of a flexible silicone polymer having a tensile strength between 350 and 1000 pounds per square inch, a percent elongation to break between 50 and 400, a Shore A hardness between 20 and 60, and a thermal conductivity in the range of 3.5 to 7.5 in units of $-10^4$ cal.–cm./sec.–cm$^{2-\circ}$ C. (ASTM test Method C177). The rest is physically configured to have a flat base panel having upper and lower surfaces, a retaining wall upwardly emergent from said upper surface about the entire perimeter of said base panel, a first series of projections upwardly directed from said upper surface, and a second series of projections downwardly directed from said lower surface.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
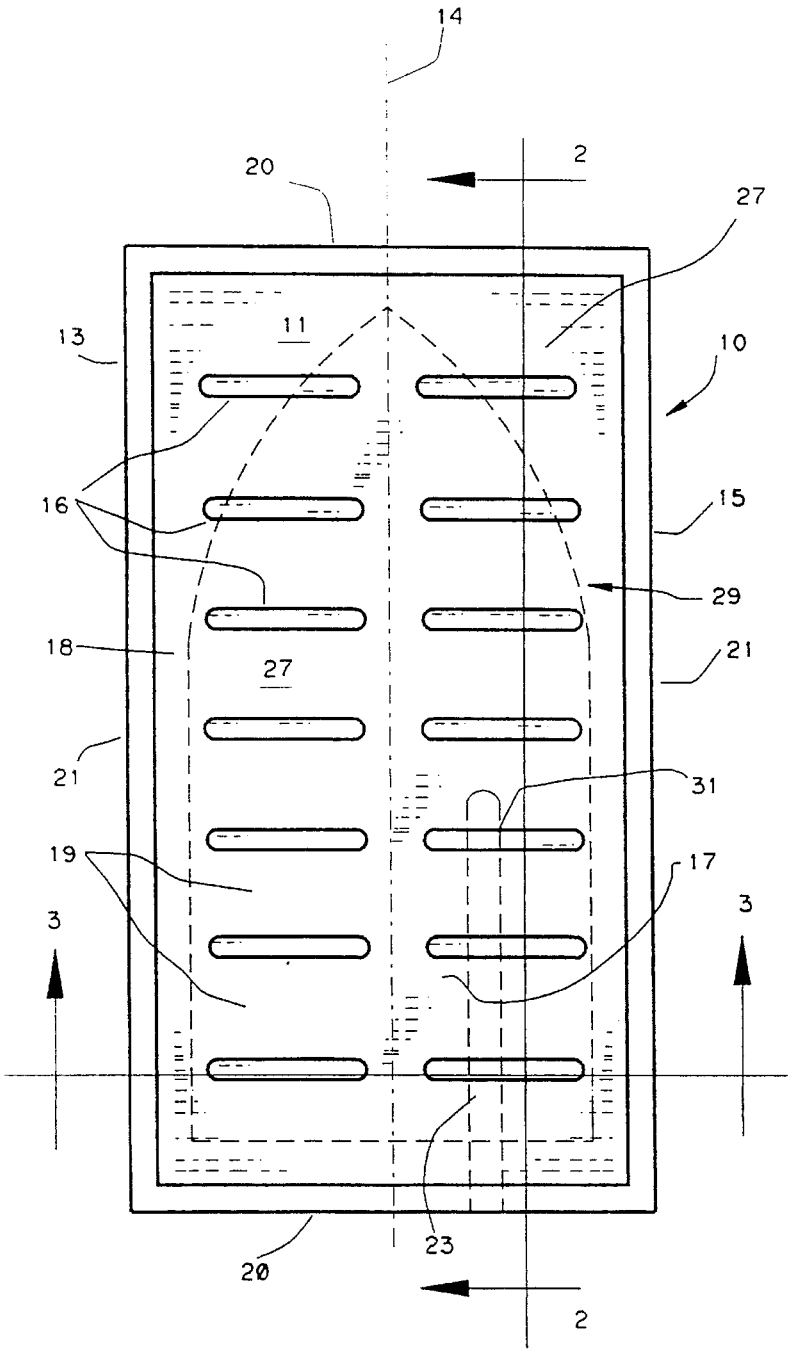
FIG. 1 is a top plan view of an embodiment of the iron rest of the present invention.
Figure 2:
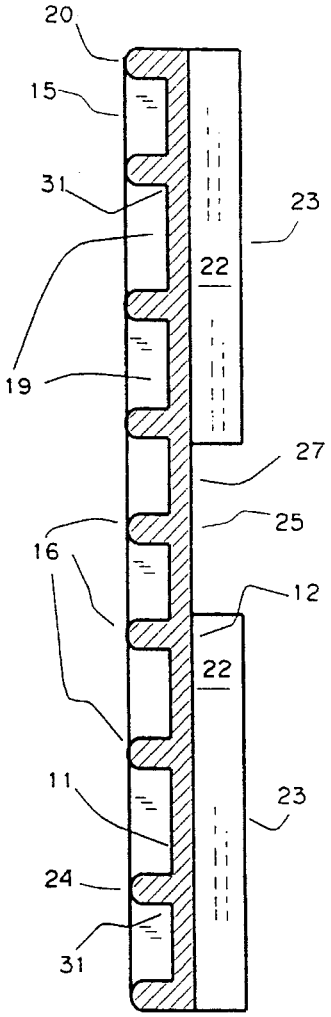
FIG. 2 is a sectional view taken in the direction of the arrows upon the line 2—2 of FIG. 1.

Referring to FIGS. 1–4, an embodiment of the iron rest 10 of the present invention is shown as a monolithic molded structure fabricated of a flexible silicone polymer. The polymer employed should have a tensile strength between 350 and 1000 pounds per square inch, a percent elongation to break between 50 and 400, a Shore A hardness between 20 and 60, and a thermal conductivity, as measured by ASTM test method C177 , in the range of 3.5 to 7.5. The Shore A hardness is preferably above 20 to provide adequate structural support, and below 60 to provide good frictional engagement of the iron 29.

The rest is shown comprised of flat base panel 27 having upper and lower surfaces 11 and 12, respectively, bounded by a perimeter 13 of rectangular configuration defined by short edges 20 and long edges 21, and elongated upon center axis 14. The short edges typically measure 5 to 6 inches, and the long edges are preferably 8 to 9 inches in length. Said base panel has a uniform thickness preferably in the range of 1–2 mm. A retaining wall 15 is upwardly emergent from said upper surface about the entire perimeter 13. The height of said wall is uniform and in the range of 2–4 mm.

A first series of projections, in the form of ribs 16 of equal height, is upwardly directed from said upper surface. Although the exemplified ribs 16 are straight and parallel, other rib configurations and placement may be employed. The heights of said ribs are preferably above said retaining wall. The dimensions and placement of the ribs 16 is such as to define center longitudinal channel 17, paired side longitudinal channels 18, and a plurality of lateral channels 19. It is important to note that, in achieving such specialized channel configuration, none of the ribs touch any portion of the retaining wall. Projections of other shapes may alternatively be employed.

The configuration of the upper surface of the base panel and associated ribs is to enable the lower surface 28 of the iron 29 to be placed upon the series of ribs. Heat from the iron is dissipated with the help of the aforementioned channel structure. Any water that exits from a steam iron will be confined by said retaining wall.

A second series of projections in the form of ribs 22 of equal height is downwardly directed from lower surface 12. Although the exemplified ribs 22 are straight and parallel, other rib configurations and placement may be employed. The height of the ribs of said second series, measured from lower surface 12 to the lowermost extremity 23 of said ribs, is between about 3 and 6 mm. The overall height of the iron rest, measured between the lowermost extremity 23 of the ribs of the second series to the uppermost extremity 24 of the ribs of said first series, is between about 7 and 12 mm. The ribs of said second series are generally positioned transversely to the ribs of said first series. Such configuration imparts greater structural support strength to the rest. The ribs of said second series are placed so as to define a lateral channel 25 and longitudinal channels 26. Said channel structure conveys heat from the underside of the rest. The ribs of said second series are preferably thicker than the ribs of said first set. The overall weight of the rest is between about 3 and 5 ounces.

Figure 3:
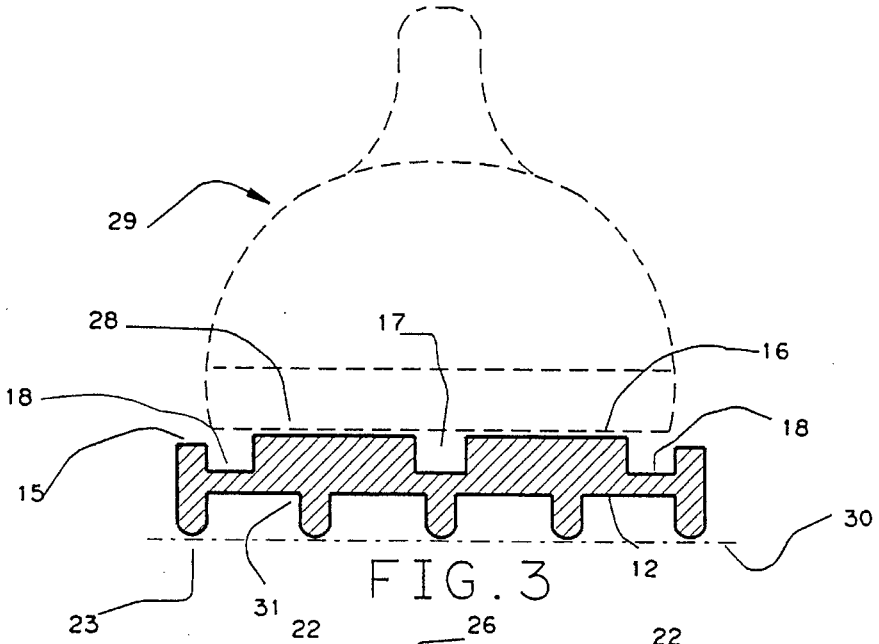
FIG. 3 is a sectional view taken in the direction of the arrows upon the line 3—3 of FIG. 1.
Figure 4:
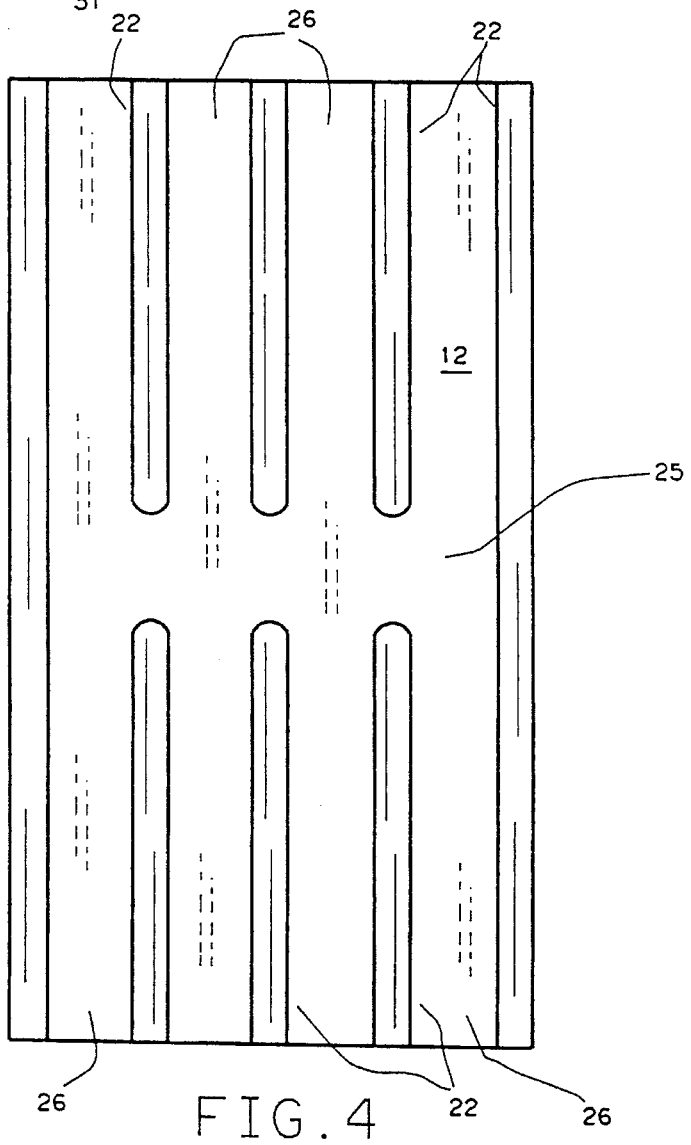
FIG. 4 is a bottom plan view of the embodiment of FIG. 1.

The transfer of heat from the lower surface 28 of the iron to the ironing board cover 30, as best shown in FIG. 3, is dependent upon three principles of heat transfer, namely: conduction, radiation and convection. Of said three modes of heat transfer, conduction through a solid substrate is by far the most significant heat transfer mechanism. In this regard, it is to be noted that the aforesaid construction of the iron rest of this invention permits minimal downward conduction of heat from the iron. In particular, the only regions of the rest which constitute continuous pathways for conduction of heat are the regions where a rib of the first series is directly above or crosses a rib of the second series. Such conductive regions, denoted by numeral 31 in FIGS. 1, 2 and 3 of the illustrated embodiment, will each typically have a horizontal cross-sectional area of about 16 square millimeters, and there are 14 of such conductive regions in the exemplified embodiment. This represents less than 1% of the total horizontal area contactable by iron 29 within perimeter 13. Accordingly, since little heat is transferred directly to the ironing board cover, while considerable heat is removed by convection and radiation, the ironing board cover survives the effects of the hot iron. In the case of a steam iron, temperature control of the rest is achieved to some extent by virtue of water that collects upon upper surface 11.

By virtue of the flexible nature of the silicone polymer, the thinness of base panel 10, and the configuration of both series of ribs, the rest is very compliant and can be rolled or folded to a compact storage state which is convenient for travellers. The softness of the silicone polymer, as indicated by its Shore A hardness value, and the compliant nature of the structure confer upon the rest the ability to non-slideably grip both the iron and the cover of the ironing board.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. An iron rest of monolithic molded construction fabricated of a flexible silicone polymer and comprising:

a) a flat base panel having upper and lower surfaces and a boundary perimeter, the thickness of said base panel, measured between said upper and lower surfaces, being uniform and in the range of 1–2 mm., b) a retaining wall upwardly emergent from said upper surface about the entire perimeter of said base panel, the height of said retaining wall being uniform and in the range of 2–4 mm., c) a first series of projections upwardly directed from said upper surface, said projections being in the form of elongated ribs of uniform height disposed in a parallel array which defines a center longitudinal channel, paired side longitudinal channels, and a plurality of lateral channels, and d) a second series of projections downwardly directed from said lower surface.

2. The iron rest of claim 1 wherein said silicone polymer has a Shore A hardness between 20 and 60.

3. The iron rest of claim 1 wherein said boundary perimeter is rectangular.

4. The iron rest of claim 1 wherein the ribs of said second series are positioned transversely to the ribs of said first series.

5. The iron rest of claim 1 having an overall height, measured between the extremities of the projections of said first and second series outermost from said base panel is between 7 and 12 mm.

6. The iron rest of claim 1 wherein the height of the ribs of said second series is between about 3 and 6 mm.

7. The iron rest of claim 1 wherein said second series of projections is in the form of elongated ribs of uniform height disposed in a parallel array.

8. An iron rest of monolithic molded construction fabricated of a flexible silicone polymer and comprising:

a) a flat base panel having upper and lower surfaces and a boundary perimeter, b) a retaining wall upwardly emergent from said upper surface about the entire perimeter of said base panel, c) a first series of projections upwardly directed from said upper surface, and d) a second series of projections downwardly directed from said lower surface, e) the projections of said first series forming an area of overlap with underlying projections of said second series.

9. The iron rest of claim 8 wherein the total of said areas of overlap is less than 1% of the area of said base panel.

10. An iron rest of monolithic molded construction fabricated of a flexible silicone polymer and comprising:

a) a flat base panel having upper and lower surfaces and a boundary perimeter, the thickness of said base panel, measured between said upper and lower surfaces, being uniform and in the range of 1–2 mm., b) a retaining wall upwardly emergent from said upper surface about the entire perimeter of said base panel, the height of said retaining wall being uniform and in the range of 2–4 mm., c) a first series of projections upwardly directed from said upper surface, said projections being in the form of elongated ribs having a uniform height greater than the height of said retaining wall, and d) a second series of projections downwardly directed from said lower surface.

* * * * *